US006668735B2

(12) United States Patent
Cassina

(10) Patent No.: US 6,668,735 B2
(45) Date of Patent: Dec. 30, 2003

(54) PALLET WITH A PLASTIC PLATFORM

(75) Inventor: Virginio Cassina, Bergamo (IT)

(73) Assignee: Fustiplast S.p.A., Bergamo (IT)

( * ) Notice: Subject to any disclaimer, the term of this patent is extended or adjusted under 35 U.S.C. 154(b) by 0 days.

(21) Appl. No.: 09/853,263

(22) Filed: May 11, 2001

(65) Prior Publication Data

US 2002/0002936 A1 Jan. 10, 2002

(30) Foreign Application Priority Data

May 15, 2000 (EP) ..... 00830348

(51) Int. Cl.[7] ..... B65D 19/38
(52) U.S. Cl. ..... 108/57.25; 108/55.1
(58) Field of Search ..... 108/57.25, 901, 108/902, 57.28, 55.1, 51.11

(56) References Cited

U.S. PATENT DOCUMENTS

| | | | | |
|---|---|---|---|---|
| 3,610,173 | A | | 10/1971 | McIlwrath |
| 3,667,403 | A | | 6/1972 | Angelbeck, Jr. |
| 3,699,901 | A | * | 10/1972 | Cook, III |
| 3,736,885 | A | * | 6/1973 | Freund |
| 3,746,204 | A | | 7/1973 | Nagai |
| 5,117,762 | A | * | 6/1992 | Shuert ..... 108/57.25 |
| 5,507,237 | A | * | 4/1996 | Barrow et al. |
| 5,549,056 | A | * | 8/1996 | Jordan et al. |
| 5,566,624 | A | * | 10/1996 | Brown et al. |
| 5,609,111 | A | * | 3/1997 | Hasegawa et al. |
| 5,667,065 | A | * | 9/1997 | Fahrion |
| D400,681 | S | * | 11/1998 | Sadr |
| 5,857,416 | A | * | 1/1999 | Donnell, Jr. et al. |
| D407,178 | S | * | 3/1999 | Evans |
| 5,887,529 | A | * | 3/1999 | John et al. |
| 5,960,720 | A | * | 10/1999 | Borland et al. |
| D417,539 | S | * | 12/1999 | Koskinen |
| D417,765 | S | * | 12/1999 | Morello |
| 6,029,583 | A | * | 2/2000 | LeTrudet |
| 6,123,032 | A | * | 9/2000 | Ohanesian |
| 6,125,770 | A | * | 10/2000 | Brandenburg |

FOREIGN PATENT DOCUMENTS

| | | | |
|---|---|---|---|
| DE | 42 137 157 | A | 5/1994 |
| EP | 1 024 089 | A2 | 8/2000 |
| GB | 1 202 353 | A | 8/1970 |
| JP | 60 090133 | A | 5/1985 |
| JP | 6 130031 | A | 6/1986 |
| WO | WO 93/18906 | | 9/1993 |
| WO | WO 97/17263 | * | 5/1997 |
| WO | WO 98/40199 | | 9/1998 |

* cited by examiner

*Primary Examiner*—Jose V. Chen
(74) *Attorney, Agent, or Firm*—Kinney & Lange, P.A.

(57) ABSTRACT

The pallet comprises a platform formed by a hollow, unitary body having two opposed major walls on which there are corresponding inwardly-extending ribs which are welded together.

Projecting portions of the platform are welded to corresponding base elements which are also formed, in threes, by hollow unitary bodies.

The resulting structure is particularly stiff and can advantageously be produced by an extrusion-blowing process with plastics material of high molecular weight.

25 Claims, 2 Drawing Sheets

PALLET WITH A PLASTIC PLATFORM

FIELD OF THE INVENTION

The invention relates to loading trays, commonly known by the term "pallets", which can be used for transporting containers of liquids and, more particularly, to a pallet with a plastics platform.

BACKGROUND OF THE INVENTION

A known palletized container for liquids or for granular materials is constituted substantially by a plastics vessel, by a cage made of profiled metal sections surrounding the vessel, and by a quadrangular steel or plastics platform on which the vessel bears and to which the cage made of profiled metal sections is fixed.

The platform has stiffening ribs and, if it is made of plastics material, is formed by a moulding process, preferably by injection. Suitable support elements are formed on or applied to the four corners and to the centre of the lower surface of the platform.

A plastics platform of this type, however, can be produced only with plastics material of relatively low molecular weight and therefore has inadequate mechanical characteristics for certain applications. Moreover, it is quite expensive since it requires specific manufacturing tooling, in particular, an injection mould.

SUMMARY OF THE INVENTION

An object of the present invention is to propose a pallet with a plastics platform which is stronger and less expensive than known pallets.

This object is achieved in accordance with the present invention by a pallet comprising a plastics platform formed by a unitary hollow body having two major walls which are disposed opposite one another and at least one of which has protuberances which extend towards the interior of the hollow body so far as to contact the opposite major wall.

BRIEF DESCRIPTION OF THE DRAWINGS

The invention will be understood better from the following detailed description of an embodiment thereof, given by way of non-limiting example with reference to the appended drawings, in which.

DETAILED DESCRIPTION OF THE PREFERRED EMBODIMENT

Figure 1:
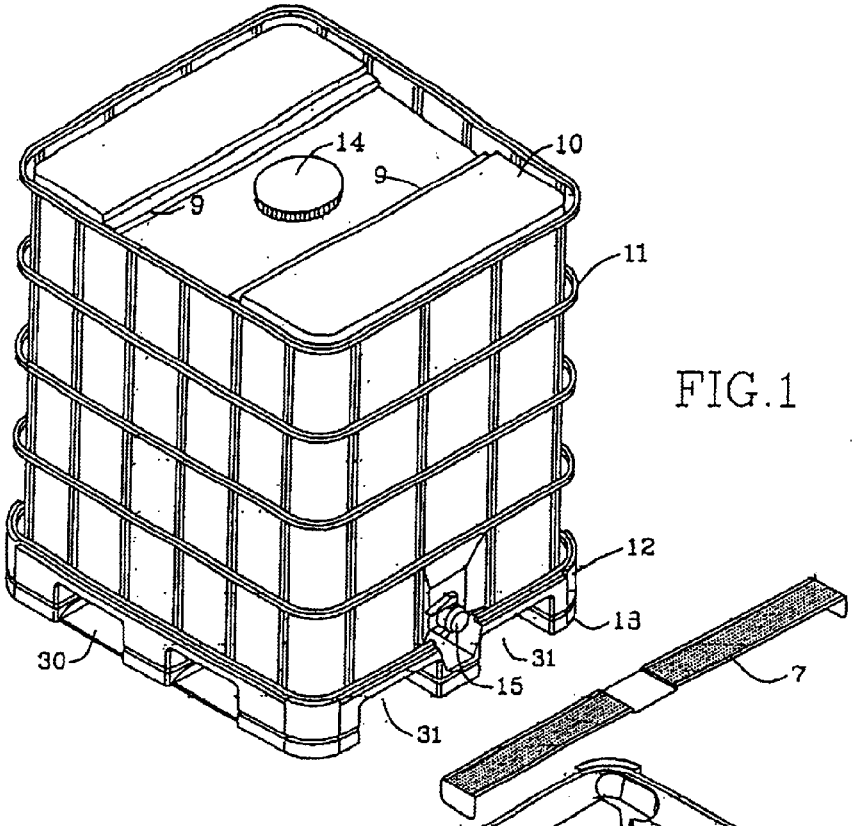
FIG. 1 is a perspective view of a palletized container which uses a pallet according to the invention.

As is shown in FIG. 1, the palletized container comprises a right-angled parallelepipedal vessel 10 with rounded corners, a cage formed by a peripheral framework 11 made of profiled metal sections arranged in a grid and welded at the points of intersection, and a pallet formed by a quadrangular plastics platform 12 on which the vessel 10 bears, and by base elements 13 fixed to the bottom of the platform.

The body of the vessel 10 is preferably made of plastics material, for example, polyethylene, by a blowing process. In the centre of its upper portion, the body has a hole which, in the drawing, is closed by a lid 14 and, at the bottom of a side wall, the body has a hole in which an outlet valve 15 is fixed.

Figure 2:
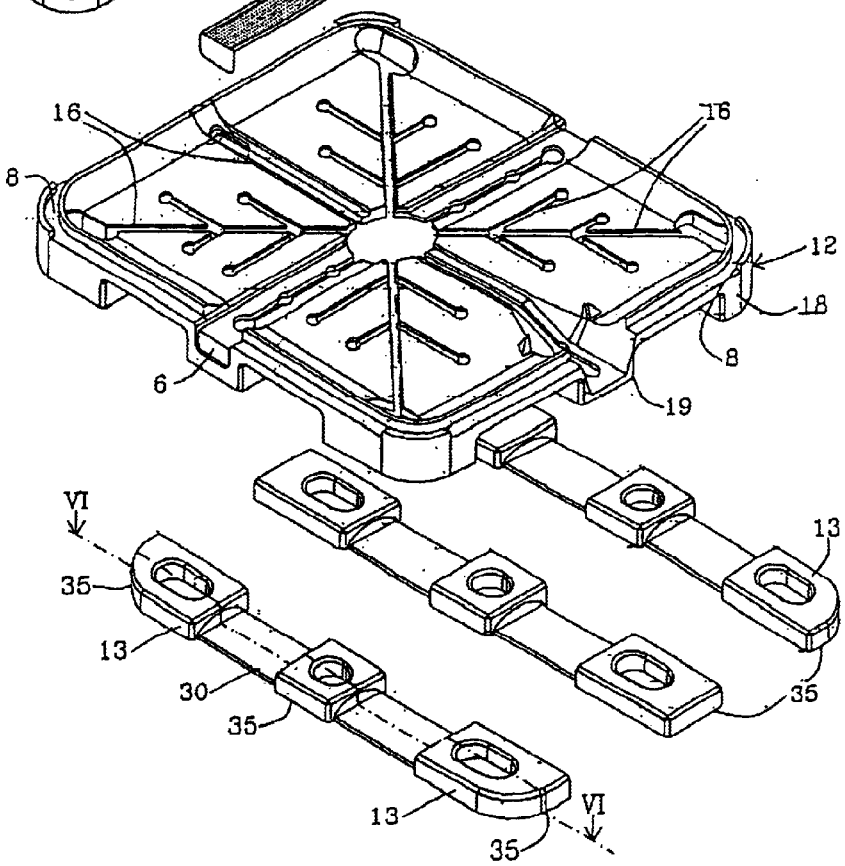
FIG. 2 shows a pallet according to the invention in perspective and with parts separated.
Figure 3:
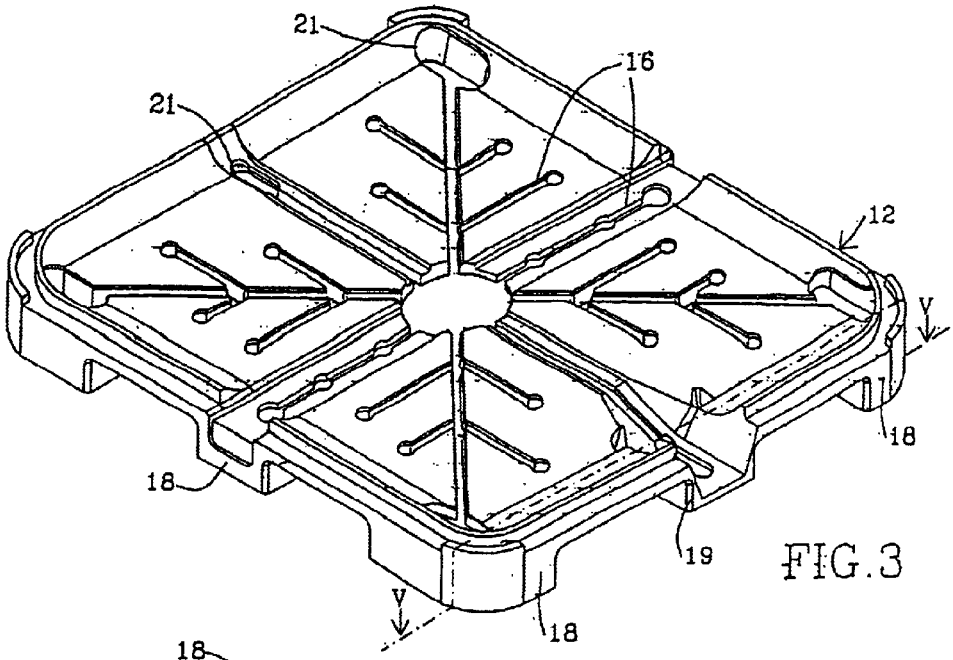
FIGS. 3 and 4 are perspective views of the platform which constitutes the main part of the pallet according to the invention, from above and from below, respectively.

The framework 11 is fixed to the platform 12 by suitable means, not shown, for example, by U-shaped bent sheet-metal strips extending around the lower peripheral section of the framework and fixed to the platform by bolts or by screws extending directly through the lower peripheral section and the underlying platform. Two cross-members 9 are fixed removably to the upper peripheral profiled section of the framework in order to hold the vessel in position. As can be seen in FIG. 2 in particular, the upper surface of the platform 12 is shaped so as to have, in the vicinity of its edge, a seat 8 for the lower peripheral section of the framework 11.

The platform 12 is constituted by a flattened, quadrangular, hollow body made of plastics material, for example, high-density polyethylene, preferably formed by an extrusion-blowing process. The blowing takes place in a mould shaped so as to create, in at least one of the main walls of the hollow body, protuberances which extend inwardly so far as to contact the opposite wall. In the embodiment shown, the protuberances are ribs which correspond to channels 16 in the outer surfaces of the hollow body, and which are formed in corresponding positions on both of the major walls. The ribs are preferably welded to one another throughout their length, inside the hollow body. The welding takes place during the blowing when the plastics material is still in the molten state.

The ribs have the function of stiffening the structure and of distributing the load throughout the surface of the platform. In this embodiment, some of the ribs extend like rays from a central region of the platform; more precisely, four ribs extend along the diagonals and four ribs extend parallel to the sides of the platform; some ribs extend as branches of the diagonal ribs in directions parallel to the sides; the ribs could, however, be arranged in a different pattern which satisfies the structural stiffening requirements and those of the blowing process equally well.

In order to stiffen the structure further, as shown in FIG. 2, a strip 7 of sheet metal may be applied to the upper surface of the platform, the strip 7 having bent ends which can be fitted in corresponding seats 6 formed centrally on two opposite sides of the platform.

Figure 4:
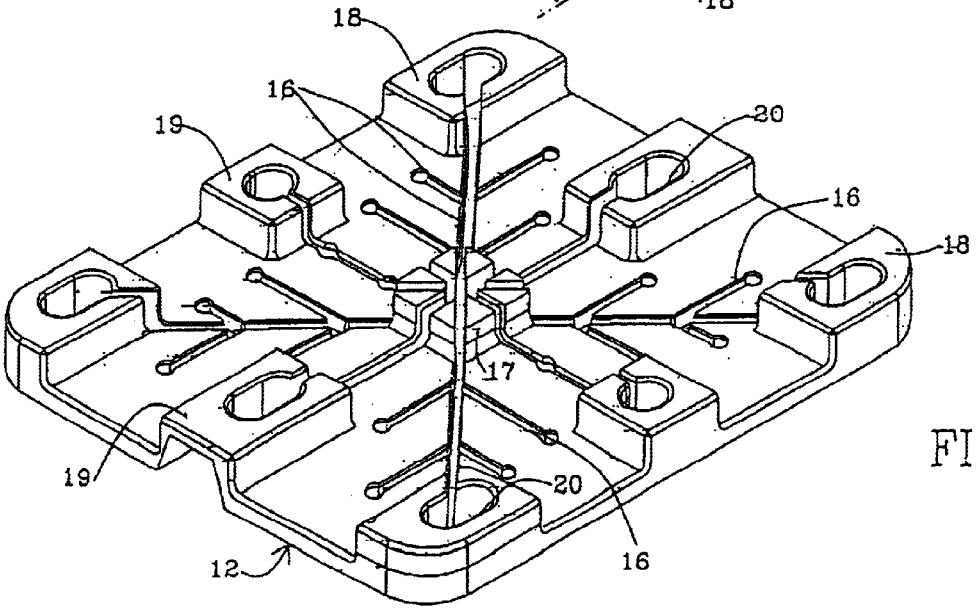
Figure 5:
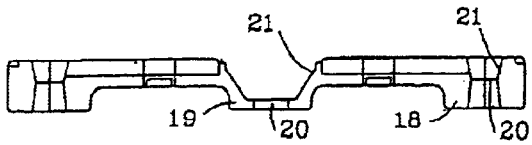
FIG. 5 is a section taken on the line V—V of FIG. 3.

The lower wall of the platform is shaped so as to have nine outwardly-projecting, that is, downwardly-projecting portions; more precisely, it has a central portion 17 (FIG. 4), four portions, indicated 18, in the vicinity of the corners, and four portions, indicated 19, in the centres of the sides. These projecting portions form nine coplanar bearing surfaces. An area (indicated 20 in FIGS. 4 and 5) of the lower surface of the platform is defined within each projecting portion. The upper wall is shaped so as to have corresponding portions 21 projecting towards the interior of the hollow body and in contact with the above-mentioned areas 20. The contact areas are preferably welded together. In the embodiment shown, the contact areas defined by the peripheral projecting portions 18 and 19 are connected to the contact area defined by the central projecting portion 17 by diagonal and median ribs, respectively. Greater stiffness of the structure is thus achieved.

According to the preferred embodiment of the invention, the base elements 13 (FIGS. 2 and 6) on which the platform 12 bears, are connected in threes by cross-members 30. Each set of three elements 13 is constituted by a hollow body formed by extrusion-blowing, that is, by the same technique which is used to form the platform 12. In fact, the hollow bodies for forming the base elements and that for forming the platform can be formed by the same extrusion-blowing cycle.

Figure 6:
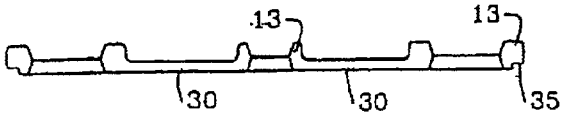
FIG. 6 is a section taken on the line VI—VI of FIG. 2.

As can be seen in FIG. 6, each base element 13 is shaped so as to have a recessed region in which two opposite walls of the hollow body are welded to one another internally to ensure greater stiffness of the support structure.

The base elements 13 can advantageously be fixed to the platform 12 by hot plate welding, that is, by placing the two portions on a plate heated to the softening temperature of the plastics and immediately afterwards bringing the surfaces to be welded into contact with one another.

The outwardly-projecting portions 17, 18, 19 and the base elements 13 together define two channels 31 (FIG. 1) for the insertion of the forks of a conventional lift truck.

The cross-members 30, together with the lower surfaces of the base elements 13, define a stable support surface which is particularly suitable for the sliding of the pallet on roller conveyors of automatic plants.

The lower surfaces of the peripheral base elements 13 advantageously have chamfers 35 (FIGS. 2 and 6) which define a peripheral seat in which the upper profiled section of the framework of a palletized container identical to that described can be fitted. This facilitates stable stacking of several containers.

The pallet according to the invention is a structure which is light and at the same time strong and which can be produced by a blowing mould which, as is known, is much less expensive than an injection mould such as those required by the prior art. This structure is produced with the use of plastics material, possibly recycled material, with a high molecular weight and therefore stronger than the plastics material which has to be used with the injection-moulding technique, which is more fluid and hence weaker when in the solid state.

A further important advantage is achieved when the pallet is intended for a palletized container in which the vessel is also made of plastics material. In this case, the overall economy permitted by the invention is particularly notable since the same apparatus which is used for the manufacture of the vessel can also be used to manufacture the pallet.

Although only one embodiment of the invention has been described and illustrated, it will be clear to an expert in the art that many variations and modifications are possible within the scope of the same inventive concept.

I claim:

1. A pallet comprising a plastics platform formed by a unitary hollow body having two major walls which are disposed opposite to and spaced from one another to form a cavity between them, at least one of said major walls having protuberances which extend through the cavity of the hollow body towards the opposite major wall so far as to contact the opposite major wall, one of the major walls having a plurality of outwardly-projecting portions, each ending in a bearing surface coplanar with the bearing surfaces of the other projecting protions, said pallet further comprising base elements fixed to the bearing surface of at least some of the outwardly-projecting portions of the platform.

2. A pallet according to claim 1, in which both of the major walls have protuberances.

3. A pallet according to claim 2, in which at least some of the protuberances of one major wall are in contact with protuberances of the opposite major wall.

4. A pallet according to claim 1, in which the protuberances are welded at the points of contact with the opposite wall.

5. A pallet according to claim 1, in which the platform is quadrangular and the protuberances comprise ribs which extend parallel to the sides of the platform and along the diagonals thereof.

6. A pallet according to claim 5, in which ribs parallel to the sides branch out from diagonal ribs.

7. A pallet according to claim 1, in which each of the outwardly-projecting portions defines an area of the respective main wall which is in contact with the opposite main wall.

8. A pallet according to claim 7, in which the opposite main wall has a plurality of inwardly-projecting portions in the region of the contact areas defined by the outwardly-projecting portions.

9. A pallet according to claim 8, which the contact areas are welded.

10. A pallet according to claim 9, in which at least two base elements are connected to one another by a cross-member.

11. A pallet according to claim 10, in which said base elements are welded to the bearing surfaces of said outwardly-projecting portions.

12. A pallet according to claim 10, in which the base elements connected by said cross-member, and the cross-member itself, are part of the same hollow body.

13. A pallet according to claim 7, in which, of the outwardly-projecting portions, one is arranged centrally, and others are arranged peripherally and have their respective contact areas connected to the contact area of the central projecting portion by means of respective ribs.

14. A pallet according to claim 1, in which at least two base elements are connected to one another by a cross-member.

15. A pallet according to claim 14, in which the base elements connected by a cross member, and the cross member itself, are parts of the same hollow body.

16. A pallet according to claim 1, in which the base elements are welded to the bearing surfaces.

17. A palletized container comprising a plastics vessel, a cage made of profiled metal sections which surrounds the vessel, and a pallet according to claim 1, on which the vessel is supported and to which the cage made of profiled metal sections is fixed.

18. A pallet according to claim 1 wherein said unitary hollow body is made of plastic material through an extrusion-blowing process.

19. A pallet according to claim 18, wherein the plastic material is a high molecular weight plastic material.

20. A pallet according to claim 19, wherein the plastic material is high-density polyethylene.

21. A pallet according to claim 1, in which both of the major walls have protuberances extending through the cavity of the hollow body, at least some of the protuberances of oe major wall being in contact with some of the protuberances of the opposite major wall and being welded at the point of contact.

22. A pallet according to claim 1, in which each of the outwardly-projecting portions defines a contact area of the respective main wall which is in contact with the opposite main wall and welded thereto.

23. A pallet according to claim 22, in which the platform is quadrangular and the protuberances comprise ribs which extend as rays from a cental region of the platform, parallel to the side of the platform and along the diagonals thereof.

24. A pallet according to claim 23, in which ribs parallel to the sides branch out from diagonal ribs.

25. A pallet according to claim 23, in which, of the outwardly-projecting portions, one is arranged centrally, and others are arranged peripherally and have their respective contact areas connected to the contact area of the central projecting portion by means of respective ribs.

* * * * *

UNITED STATES PATENT AND TRADEMARK OFFICE

CERTIFICATE OF CORRECTION

PATENT NO. : 6,668,735 B2
DATED : December 30, 2003
INVENTOR(S) : Virginio Cassina It is certified that error appears in the above-identified patent and that said Letters Patent is hereby corrected as shown below:

Column 4,
Line 49, delete “oe” and insert -- one --

Signed and Sealed this

Twenty-fourth Day of February, 2004

JON W. DUDAS
*Acting Director of the United States Patent and Trademark Office*